United States Patent [19]

Kaufer

[11] 3,949,969

[45] Apr. 13, 1976

[54] CABLE WINCH

[76] Inventor: Carl Kaufer, D-5291 Kupferberg near Wipperfurth, Germany

[22] Filed: Jan. 16, 1974

[21] Appl. No.: 433,746

[30] Foreign Application Priority Data

Feb. 15, 1973 Germany ..... 2307370

[52] U.S. Cl. ..... 254/175.7; 254/157

[51] Int. Cl.[2] ..... B66D 1/76

[58] Field of Search ..... 254/161, 170, 175.5, 175.7, 254/191, 159, 157; 242/150, 45; 226/187; 188/65.4

[56] References Cited

UNITED STATES PATENTS

| | | | |
|---|---|---|---|
| 2,523,387 | 9/1950 | Natzke | 226/187 |
| 2,780,318 | 2/1957 | Owens | 254/191 |
| 2,979,829 | 4/1961 | Uhleen | 254/175.5 |
| 2,990,131 | 6/1961 | Carlsson | 254/157 |
| 3,055,638 | 9/1962 | Good | 254/175.5 |
| 3,309,064 | 3/1967 | Muller et al. | 254/175.7 |
| 3,520,515 | 7/1970 | Pomagalski et al. | 254/175.5 |
| 3,662,992 | 5/1972 | Vittert | 254/157 |
| 3,677,555 | 7/1972 | Vail et al. | 226/187 |
| 3,717,325 | 2/1973 | Peterson | 254/175.7 |

FOREIGN PATENTS OR APPLICATIONS

| | | | |
|---|---|---|---|
| 1,519,591 | 11/1966 | France | 254/175.5 |
| 54,087 | 11/1967 | Germany | 254/175.5 |

*Primary Examiner*—Robert J. Spar
*Assistant Examiner*—Kenneth Noland
*Attorney, Agent, or Firm*—Mandeville and Schweitzer

[57] ABSTRACT

A cable winch comprising a driving sheave or wheel rotatably mounted in a housing and rotated by a motor or hand-crank. The driving sheave has a peripheral groove to receive the cable. A tensioning wheel, whose position is variable, is rotatably mounted in the housing adjacent the cable inlet for guiding the cable towards the driving sheave, and a pressure wheel is also rotatably mounted in a variable position in the housing for pressing the cable against the driving sheave according to the tension in the cable. The tensioning wheel and the pressure wheel may be eccentrically pivotally mounted in the housing, the mounting of one wheel being coupled to the mounting of the other by an articulated linkage system.

12 Claims, 9 Drawing Figures

FIG. 3
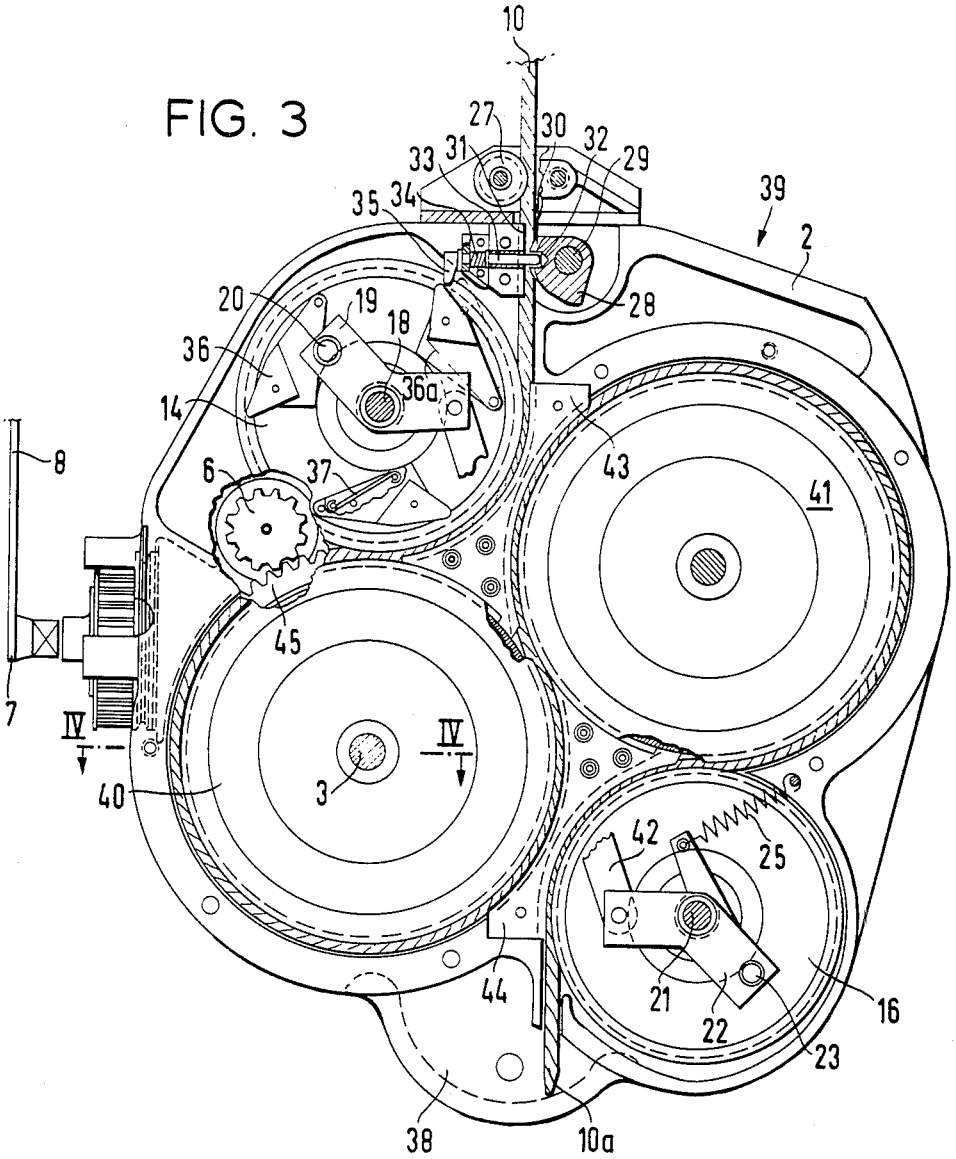
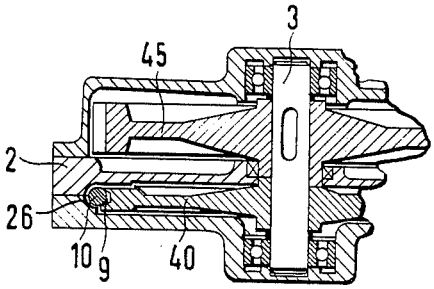
FIG. 4

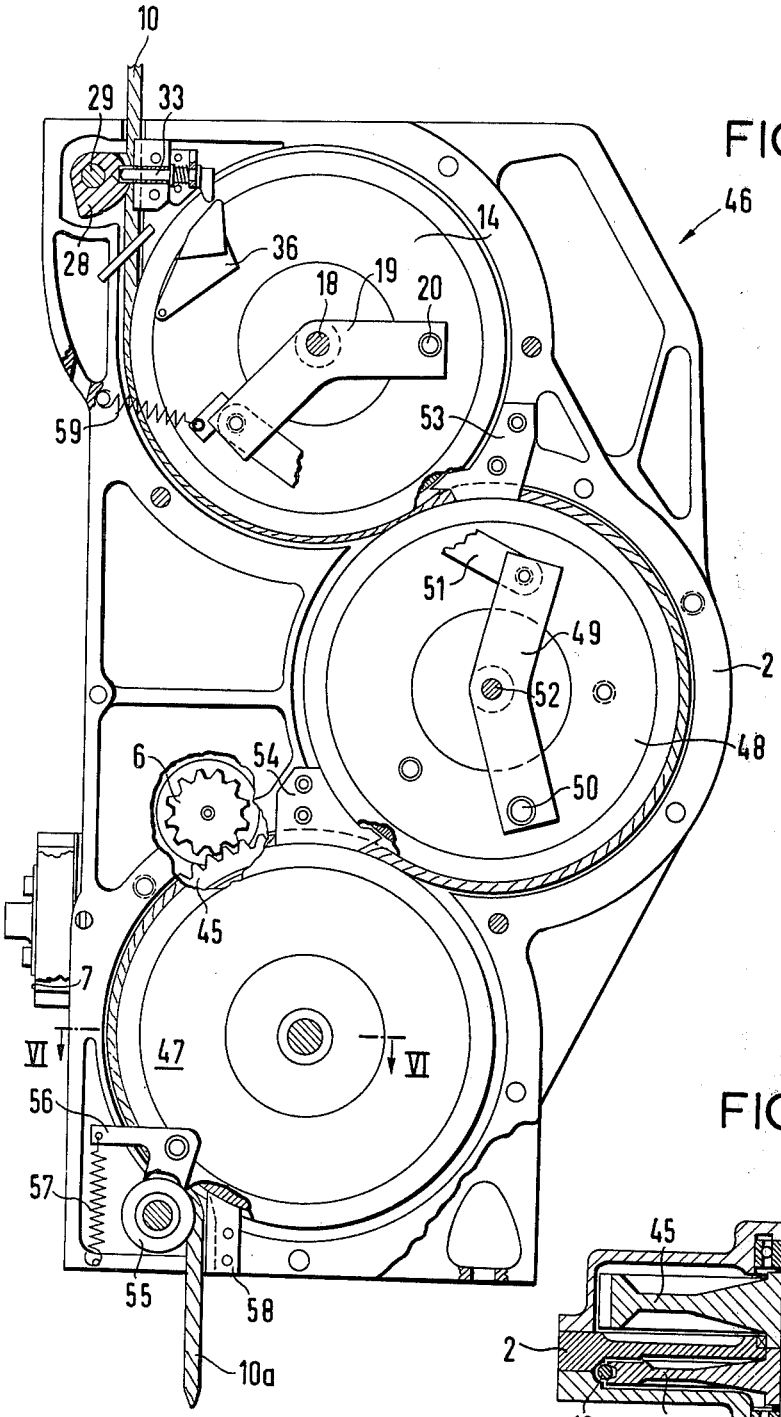
FIG. 5
FIG. 6
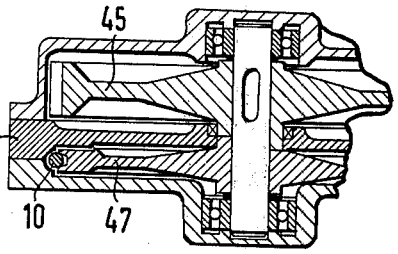

CABLE WINCH

BACKGROUND TO THE INVENTION

This invention relates to a cable winch, and in particular to a cable winch intended especially for suspended staging, comprising a driving sheave or wheel for the cable mounted in a housing and intended to be driven by a drive arrangement. The driving sheave has a circumferential groove to receive the cable. The winch also comprises an adjustable tensioning wheel on the feed side to guide the cable onto the sheave and a pressure-applying element which presses the cable onto the driving sheave according to the tension in the cable.

A cable winch of this type has been disclosed in German Offenlegunschrift No. 2,041,993. In this known winch, the cable is pressed by means of an eccentrically pivotally mounted tensioning wheel or jockey wheel and a link-belt into the circumferential groove of the driving sheave, the link-belt being attached at one end to a fixed point of the housing, in order to envelop the greater part of the sheave and being attached at its other end to a lever, which is pivotally mounted at its opposite end upon the housing and carries approximately at the middle the tensioning wheel, over which the infeeding cable runs. If the infeeding cable is under tension, then it presses the tension wheel to the side, causing the lever which carries this wheel to be pivoted and the link-belt attached to the lever to be tensioned. The tensioned link-belt in turn presses the cable into the circumferential groove of the drive sheave with a force proportional to the cable tension, so that the cable is prevented from slipping in the groove of the drive sheave. The cable is in fact pressed so firmly into the groove of the driving sheave, that slip-free engagement of the cable is ensured when the drive sheave is driven by a transmission from a motor or by a handcrank.

In a cable winch known from DT-PS 1,218,681, the tensioning wheel mounted at the free end of the link-belt which leads around approximately half the driving sheave, is displacably mounted in longitudinal slots. Although in these known cable winches, the cable can be pressed over a large portion of the circumference of the driving sheave into the groove of this sheave, and thus a slip-free bearing of the cable upon the driving sheave is ensured, it has been demonstrated in practice that the link-belt is subjected at certain positions to a disproportionately high loading and accordingly wears rapidly in a disproportionate manner, while at other positions there is hardly any wear at all, which indicates that the pressing force of the link-belt is not uniform everywhere. Instead, the pressing force of the link-belt is at its maximum just after the fixed attachment point to the housing. In such cases it has also been found that non-circularity in the cross-section of the cable leads to difficulties in passage between the driving sheave and the link-belt, which can be so serious that in the vicinity of the exit end of the link-belt, the cable is no longer driven forwards, while in the remaining range of the driving sheave the cable continues to be driven through. Consequently, the link-belt which serves as the pressing element can become completely destroyed within a short period.

The problem underlying the invention consists in the provision of a cable winch which shall be of simpler yet substantially more reliable design and in which the cable shall be pressed into the groove of the driving sheave with sufficient force and without any pressing element enveloping the periphery of the drive sheave; the drive for the sheave shall also be more simply constructed.

SUMMARY OF THE INVENTION

For the solution of this problem it is proposed, in a cable winch of the type initially described, that the pressing element shall be a wheel mounted in the housing and adjustable relative to the drive sheave.

Accordingly, the invention provides a cable winch comprising a housing having a cable inlet and a cable outlet, a driving sheave mounted in the housing, said driving sheave having a circumferential groove for receiving the cable, means for driving said sheave, a tensioning wheel mounted in an adjustable position in the housing adjacent the cable inlet for guiding the cable towards the driving sheave, and a pressure wheel mounted in the housing and movable relative to the driving sheave for pressing the cable against the driving sheave in accordance with the tensile stress obtaining in the cable.

Where an eccentrically, pivotally mounted tensioning wheel is used, this pressure wheel may, for instance, likewise be eccentrically, pivotally mounted, its mounting being coupled to the eccentric mounting of the tensioning wheel by means of a pivoting linkage mechanism.

In contra-distinction to a link-belt, the pressure wheel provided according to the invention presses the cable onto the driving sheave at one point only, which has proved to be sufficient for pressing the cable over its entire path around the driving sheave so firmly into the groove of this sheave, that a slip-free driving action is ensured. The reason for this lies in the fact that the cable, when under tension, tends to be drawn from the driving sheave in the direction of the tensioning wheel. If for example the pressure wheel is situated at the position at which the cable is again drawn off the driving sheave, that is at the exit end from the sheave, the tensioning wheel being by contrast at the infeed end to the sheave, then the pressure wheel presses the cable with a force proportional to the cable tension into the groove of the driving sheave, causing the tension obtaining in the cable to act around the entire periphery of the driving sheave as a force, which presses the cable into the groove of this sheave.

According to a first commercial embodiment of the invention, both the tensioning wheel and also the pressure wheel are each mounted upon a lever, each lever being pivotally mounted at one end in the housing and the levers being connected together by means of a rod, which rod is linked at its two ends to the free end of the associated lever which is opposite to the bearing of the associated wheel. The tensioning wheel and pressure wheel are therefore each mounted in the housing on a lever of a pivoting linkage mechanism constituted of three parts, so that the tensile force in the cable acting upon the tension wheel, which raises this tension wheel from the driving sheave, has the effect that the pressure wheel presses the cable onto the driving sheave with a force corresponding to this tensile force, causing the cable to be drawn uniformly into the groove of the driving sheave, also in a uniform manner, due to the tensile force obtaining in it.

A stressed spring may also be mounted between the pressure wheel and the housing to press the pressure wheel onto the driving sheave; this ensures that the pressure wheel is always in the operating position, even when there is little or no loading. Automatic threading of the cable into the winch is thereby ensured.

According to a second commercial embodiment of the invention two adjacently mounted drive sheaves may be arranged in the housing, between the tensioning wheel and the pressure wheel, the tensioning wheel conducting the cable onto the first drive sheave and the pressure wheel pressing the cable onto the second drive sheave. Here again, the tensioning wheel and the pressure wheel can be mounted on levers pivotally linked to the housing, the free ends of the levers being connected together by a rod, so that the pressure wheel presses the cable onto the second drive sheave with a force proportional to the cable tension. The drive sheaves are so arranged that the cable leads directly from the one drive sheave onto the other, that is the two drive sheaves are only sufficiently far apart for the cable to be conducted straight between them. In this embodiment also, the pressure wheel is pressed by means of a stressed spring onto the associated driving sheave. A cable winch of this type can be accurately calibrated with respect to weight, because the cable infeed and cable outfeed can lie practically at the centre of the housing and practically one above the other.

According to another commercial embodiment of the invention, the pressure wheel is situated between the tension wheel and the driving sheave. Here, the tensioning wheel and pressure wheel can be mounted by means of a lever linkage eccentrically and pivotally and so that they are pressed against each other. It is also possible to journal the tensioning wheel and driving sheave at fixed positions and have the pressure wheel adjustable relative to these two. The pressure wheel may then be mounted in sliding blocks, which are slidably mounted under a spring force in the housing. In these embodiments, a further pressure wheel may favourably be eccentrically and pivotally mounted at the exit end from the driving sheave; this further pressure wheel can be pressed by means of a stressed spring against this driving sheave.

These embodiments of the invention possess the advantage that the cable winch can be constructed to be very compact overall and that it is possible to manage with a driving sheave of relatively small diameter, because the cable runs over three sheaves or wheels, between which it is firmly pressed at each position. The infeed and outlet for the cable can be situated exactly beneath one another. It is necessary only to drive the driving sheave at the cable exit side; in this case, as in the embodiments mentioned above, there is the particular advantage that, for the purpose of driving the driving sheaves, a gear wheel with external teeth can be used, instead of a gear wheel having internal teeth, as is the case where a large driving sheave is used according to the known state of the art.

In all preferred embodiments, the housing fits closely up to the external periphery of the individual driving sheaves and comprises a circumferential groove which surrounds that portion of the cable projecting from the driving sheave and thereby constitutes, together with the driving sheave, a virtually closed guide, which in addition ensures an automatic threading in of the cable. This groove may, if necessary, contain rollers or other devices for reducing possible friction between the cable and the groove.

As a safety precaution against overrunning of the winch, a further preferred feature of the invention provides, in the vicinity of the tensioning wheel, a flywheel brake co-operating with the tensioning wheel, which brakes the cable if the cable runs too rapidly over the tensioning wheel. This flywheel brake may for example consist of an eccentrically pivotally mounted brake jaw, co-operating with the cable running through it, and a locking mechanism for this jaw, this mechanism being released when a predetermined rotational speed of the tensioning wheel is exceeded, so that the pivotally mounted braking jaw presses the cable against a fixed counter-jaw as a result of its motion. The brake will therefore be applied when a threshold value of the cable speed and thus of the rotational speed of the tensioning wheel is exceeded and has an immediate braking effect upon the cable, so that the cable winch and any suspended scaffolding or other loads suspended from it cannot run away. When the error has been rectified, the flywheel brake is released from the cable and returned to its rest position, so that the cable winch can again be used in the normal way.

The locking mechanism for the pivoting brake jaw may consist for example of a spring-loaded pin, which normally engages in an opening situated on the side of the pivotal braking jaw and is disengaged by means of an outwardly pivoting releasing lever mounted on the tensioning wheel and subject to centrifugal force; when disengaged, this pin releases the braking jaw which then bears against one side of the cable running through it and presses this against a fixed jaw, the cable itself then pulling this brake closed.

BRIEF DESCRIPTION OF THE DRAWINGS

Embodiments of the invention will now be described by way of example, with reference to the accompanying drawings, in which:

FIG. 3 is a view similar to FIG. 1 of a second embodiment of a cable winch according to the invention;

FIG. 4 is a partial section along line IV—IV of FIG. 3;

FIG. 5 is a partly cut-away side view of a third embodiment of a cable winch according to the invention;

FIG. 6 is a partial section along line VI—VI of FIG. 5;

DESCRIPTION OF PREFERRED EMBODIMENTS

Figure 1:
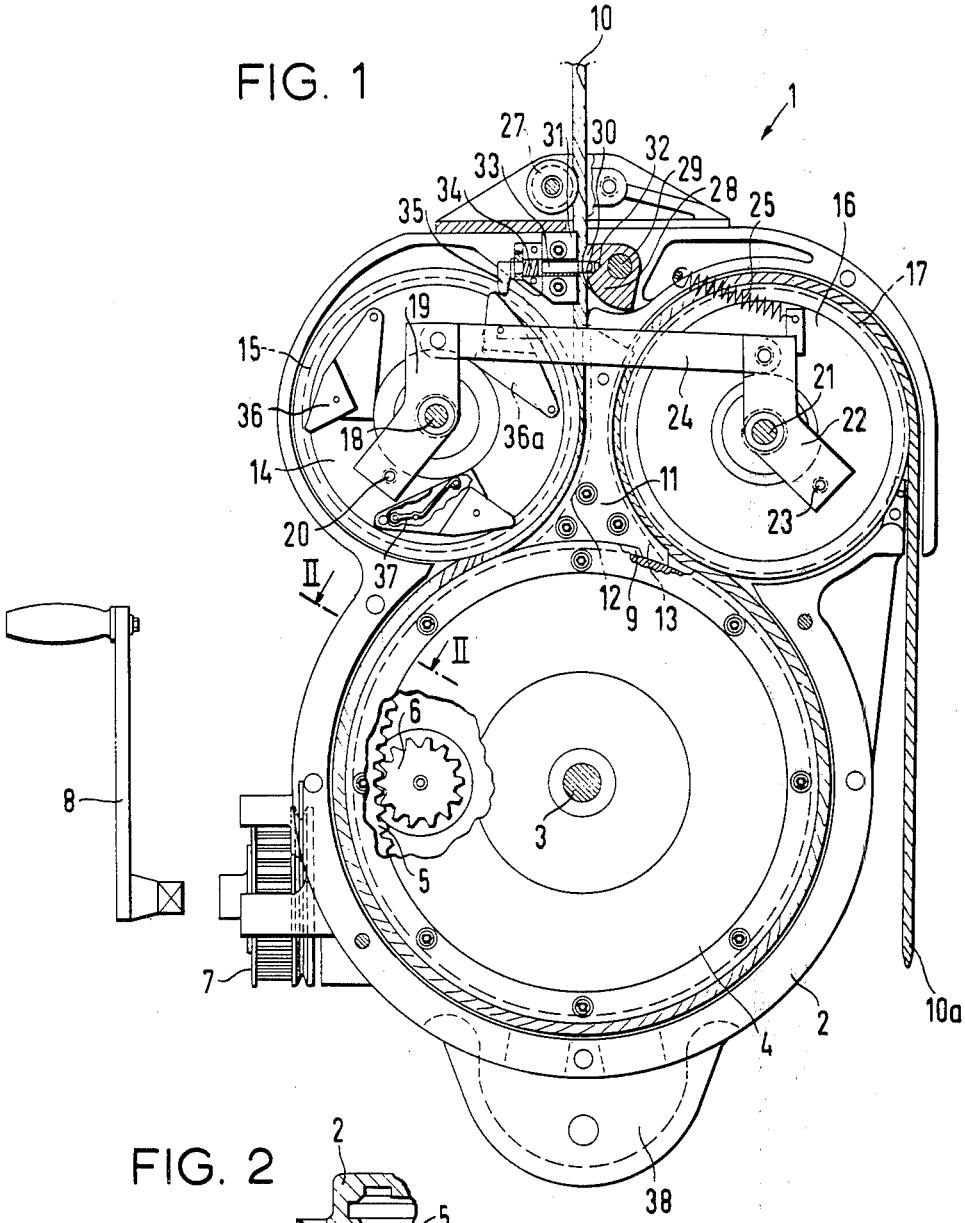
FIG. 1 is a partly sectioned side view of a first embodiment of a cable winch according to the invention, the cover of the housing being omitted.
Figure 2:
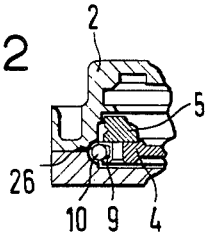
FIG. 2 is a partial section along line II — II of FIG. 1.

A cable winch 1 illustrated in FIGS. 1 and 2 possesses a housing 2, in which a driving sheave 4 with an internally toothed ring 5 flanged to it is journaled on a shaft 3. A drive pinion 6 engages the internal teeth of the ring 5 and forms part of a drive mounted on the rear side of the housing 2 and therefore not shown in more detail in the drawing; this drive possesses a drive motor and a worm gear. The worm gear is equipped with a brake 7, to assist the self-locking or non-reversing action of the gear. In cases where there is no drive motor, a hand crank 8 can be fitted onto the gear, enabling the cable winch 1 and a load suspended therefrom to be lowered.

The driving sheave 4 is furnished around its external periphery with a wedge-shaped groove 9, into which a cable 10 is pressed. The cable 10 is conducted once around the driving sheave 4, the infeed and exit of the cable being close together, thus resulting in a very large angle of wrap of the cable. Between the infeed and exit ends of the cable is mounted a fixed cable guide 11, possessing on its two sides grooves 12 and 13 for guiding the cable 10.

In FIG. 1, on the left side of the cable guide 11 a tensioning wheel 14 is journalled in the housing 2; the wheel 14 has a circumferential wedge-shaped groove 15 and, in conjunction with the cable guide 11, guides the cable 10 onto the driving sheave 4. Opposite to the tensioning wheel 14 a pressure wheel 16 is journalled in the housing 2, the cable 10 being led over this wheel with the help of the fixed cable guide 11, off the driving sheave 4 and out of the housing 2. The cable end 10*a* hangs down from the housing 2. The pressure wheel 16 also comprises a wedge-shaped groove 17 around its periphery, in which the cable 10 lies.

The tensioning wheel 14 is journalled by means of a shaft 18 between two levers 19, of which only one is illustrated in the drawing. The levers 19 are each pivotally mounted at a fixed pivotal point 20 in the housing 2. The tensioning wheel 14 is thus eccentrically pivotally mounted in the housing 2.

The pressure wheel 16 is journalled in a similar manner with a shaft 21 on levers 22, which are pivotally mounted in the housing 2 on fixed pivot points 23.

The angle-shaped or elbow-shaped levers 19 and 22 are connected together at their upper, free ends by means of a rod 24 articulated to them, resulting in an articulated coupling between the levers 19 and 22 which has the effect that, when the levers 19 are pivoted to the left, the levers 22 are also pivoted to the left and vice versa. In this manner, the cable 10 is pressed by the pressure wheel 16 into the wedge groove 9 of the driving sheave 4 proportionally to the tensile stress in the cable, since an axial pull in the cable 10 pushes the tensioning wheel 14 to the left and accordingly the levers 19 and 22 are pivoted towards the left.

A tension spring 25 engages the pressure wheel 16; this presses the pressure wheel with a light prestress in the direction towards the driving sheave 4, but this pressure force is not sufficient to press the cable 10 firmly into the groove 9 of the driving sheave 4. For this purpose, the force transmitted from the tensioning wheel 14 to the pressure wheel 16 and proportional to the tension in the cable 10, is required.

The cable 10 runs, in the region of the driving sheave 4, with its externally oriented portion in a surrounding groove 26 of the housing 2, so that the cable is subjected to constrained guiding almost throughout its passage inside the housing 2 and can be automatically threaded in without it being necessary to open the housing for this purpose.

Guide rollers 27 are situated at the infeed end to the housing 2; these guide the cable 10 into the housing. Below these guide rollers, a braking jaw 28 is eccentrically pivotally mounted in the housing 2 on a pin 29. The braking jaw possesses a spirally shaped section 30, which overlaps the cable 10 in a semi-circular shape and, when the braking jaw 28 is free to pivot, is entrained by the cable 10 as it runs towards the guide rollers 27. Opposite to the pivotal braking jaw 28, there is mounted in the housing 2 a fixed braking jaw 31, against which the cable 10 is pressed by the pivoting braking jaw 28 when the braking jaw 28 can be entrained by the running out cable.

On the front side, as seen in FIG. 1, of the eccentrically pivotal braking jaw 28, there is located a projection, shown in section in the drawing, which contains a blind hole 32. A locking pin 33 is normally engaged into this blind hole 32; the locking pin is pressed by a spring 34 mounted thereon towards the braking jaw 28. At the rear end of the locking pin 33 is a downwardly projecting nose 35.

Three levers 36, pivotally mounted on the tensioning wheel 14, can co-operate with this downwardly projecting nose 35; the levers 36 are normally pressed by a strip spring 37 housed in each of them into the position illustrated in full lines in FIG. 1. Should however the rotational speed of the tensioning wheel 14 exceed a specific threshold value, then the centrifugal force acting upon the levers 36 exceeds the force of the strip springs 37, so that the levers 36 are rotated into the position 36*a* illustrated in broken lines in FIG. 1. In this position, one of the levers 36 engages the locking pin 33 be means of its nose 35 and pulls it towards the left, so that the pin 33 emerges from the blind hole 32 of the braking jaw 28, and the braking jaw 28 is thereby released. The braking jaw 28 is then rotated by the running cable 10 into the braking position, the braking force corresponding to the tensile force in the cable; thus it is ensure that the cable is effectively braked between the braking jaws 28 and 31.

An eye 38 for the attachment of a load, not shown, is located on the underside of the housing 2.

The cable winch 39 illustrated in FIGS. 3 and 4 contains numerous components which are also present in the cable winch of FIGS. 1 and 2, so that those components of FIGS. 3 and 4 which fulfil the same functions are given the same reference numerals and are not further discussed.

A difference from the embodiment according to FIGS. 1 and 2 is that, in FIGS. 3 and 4 two driving sheaves 40 and 41 instead of one, are journalled in the housing 2; the cable 10 is led around these in an approximately S-shape. Both the driving sheaves 40 and 41 are driven together from a drive system comprising a worm gear, not shown, mutually engaging toothed wheels 45 being provided for this purpose on the outer peripheries of the driving sheaves. A drive pinion 6 engages one of these toothed wheels. The tensioning wheel 14 and the pressure wheel 16 are accordingly further apart, so that the rod 42 joining together the levers 19 and 22 is longer than the rod 24 in the embodiment according to FIG. 1. In the present case also, there are two fixed cable guides 43 and 44 in the housing 2, which in conjunction with the grooves 26 provided in the housing 2 ensure that the cable 10 is guided in a constrained manner along the correct path through the housing 2, thus enabling this cable to be automatically fed in.

In the embodiment according to FIGS. 5 and 6, there are once again numerous components which are functionally equivalent to those in the previously discussed embodiments so that here again the same reference numerals will be used for these components.

The cable winch 46 of FIGS. 5 and 6 differs from the cable winches according to the previous embodiments essentially in that, between the tensioning wheel 14 and the drive sheave 47, there is provided a first pressure wheel 48, which constitutes the infeed to the driving sheave 47, while a second pressure wheel 55 is situated at the exit from the driving sheave 47. The tensioning wheel 14 and the pressure wheel 48 are eccentrically, adjustably mounted and are connected together by means of a lever mechanism in such a way that a tensile force in the cable 10 exerted upon the tensioning wheel 14 is converted into a corresponding pressure force of the pressure wheel 48.

In the present case, the tensioning wheel 14 is mounted on levers 19 which are mounted to pivot in the housing 2 about a fixed pivot point 20. The pressure wheel 48 is journalled on levers 49 which are mounted to pivot about a fixed pivot point 50 in the housing. The free ends of the levers 19 and 49 are connected together by a rod 51, articulated to the ends of each of them. Since the pivot point 50 is situated below the horizontal centre line of the pressure wheel 48, as shown in FIG. 5, the shaft 52 of the pressure wheel 48 can be pivoted through an arc of a circle such that, when a pull is transmitted through the rod 51 to the levers 49, the pressure wheel 48 is pressed both against the eccentrically pivotally mounted tensioning wheel 14 and also, in particular, against the driving sheave 47.

In the housing, between the tensioning wheel 14 and the pressure wheel 48, there is a fixed cable guide 53, while a further fixed cable guide 54 is mounted between the pressure wheel 48 and the driving sheave 47. The pressure wheel 55 is so pivotally journalled on elbow levers 56 and under the influence of a tension spring 57 in the housing 2 that it redirects the outfeeding cable end 10*a* downwards, opposite to a further fixed cable guide 58.

On the rear side of the driving sheave 47 there is a gear wheel 45 having an external toothed arrangement, which is driven by a pinion 6 from the worm gear drive, not shown in detail.

In this embodiment, the tensioning wheel 14 is prestressed by means of a tension spring 59 in such a way that the wheel presses against the infeeding cable 10.

Figure 7:
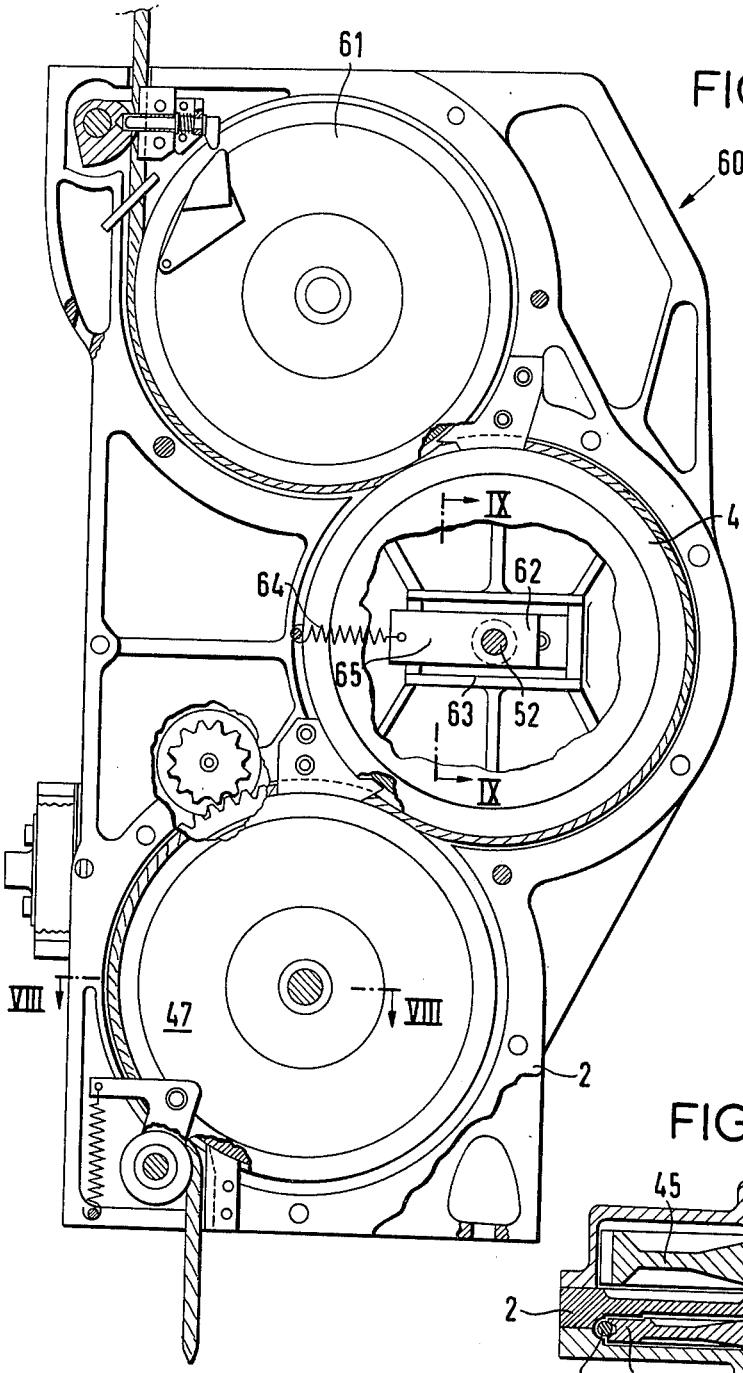
FIG. 7 is a partly cut-away side view of a fourth embodiment of a cable winch according to the invention.
Figure 9:
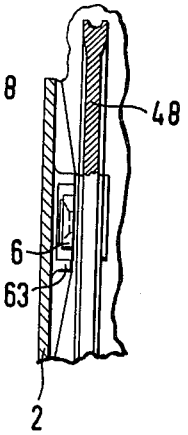
FIG. 9 is a partial section along IX—IX of FIG. 7.
Figure 8:
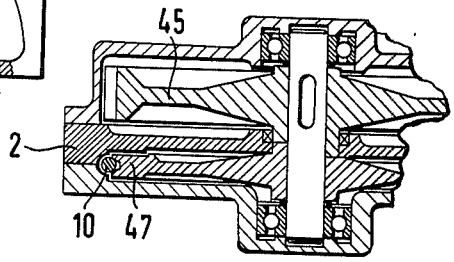
FIG. 8 is a partial section along line VIII—VIII of FIG. 7.

The cable winch 60 according to FIGS. 7 to 9 differs from the cable winch according to FIGS. 5 and 6 essentially in that the tensioning wheel 61 and driving sheave 47 have journals fixed relative to the housing 2, whereas the pressure wheel 48 is journalled with its shaft 52 in sliding blocks 62. The sliding blocks 62 are slidably mounted in a horizontal guide 63 in the housing 2 and are subject to the prestress of a tension spring 64. Because the sliding block 62 can slide along a horizontal axis 65, the pressure wheel 48 is pressed both against the tension wheel 61 and also against the driving sheave 47 which are journalled one above the other in the housing 2 with a spacing between them less than the diameter of the pressure wheel 48.

When the cable 10, led through the housing 2, is subjected to a tensile stress, it attempts to slide upwards out of the housing. Because of the friction upon the individual wheels and sheaves, the cable cannot directly slide outwards however. Instead, the cable will press the pressure wheel 48 against the fixed tensioning wheel and also against the fixed driving sheave with a force proportional to the tensile stress in it; this once again ensures that the cable runs practically slip-free over the wheels 61 and 48 and the driving sheave 47.

Although in this embodiment only the pressure wheel 48 is adjustable in position, the functioning of the cable winch 60 is in practice equivalent to the function of the cable winches of the aforementioned embodiment.

I claim:

1. A cable winch comprising a. a housing with a cable inlet and a cable outlet;

b. a cable passing through said housing from said inlet to said outlet;

c. driving sheave means mounted for rotation in said housing, said driving sheave means having a circumferential groove for receiving said cable;

d. driving means connected to said driving sheave means;

e. a tensioning wheel eccentrically pivotally mounted for rotation in said housing adjacent said inlet;

f. a pressure wheel eccentrically pivotally mounted for rotation in said housing adjacent said driving sheave means, for urging said cable into said circumferential groove of said driving sheave means; and g. an articulated linkage coupling the mounting of said tensioning wheel to the mounting of said pressure wheel;

h. the axis of said pressure wheel being parallel to and movable relative to the axes of said tensioning wheel and said driving sheave means;

i. whereby tension on said cable causes said pressure wheel to urge said cable into said circumferential groove in direct relation to the degree of said tension.

2. A winch according to claim 1, wherein both the tensioning wheel and the pressure wheel are each rotatably mounted upon a lever, each lever being pivotally mounted at one end in the housing and the other ends of the levers being connected to one another by means of a rod which is articulated at its two ends to the free other ends of the levers opposite to the bearing of the associated wheel.

3. A winch according to claim 1, wherein a tension spring is mounted between the pressure wheel and the housing which presses the pressure wheel against the driving sheave.

4. A winch according to claim 1, wherein the pressure wheel is situated between the tensioning wheel and the driving sheave.

5. A winch according to claim 4, wherein a further pressure wheel journalled to pivot eccentrically under spring bias is mounted in the housing at the exit end of the driving sheave.

6. A winch according to claim 4, wherein a tension spring is mounted between the tensioning wheel and the housing for pressing the tensioning wheel against the infeeding cable.

7. A winch according to claim 1, wherein a gear wheel having external teeth is fixed to one side of the driving sheave for use in driving said sheave.

8. A winch according to claim 1, wherein the housing closely embraces the external periphery of the driving sheave and comprises a circumferential groove to house that portion of the cable which projects beyond the driving sheave.

9. A cable winch comprising a. a housing with a cable inlet and a cable outlet;

b. a cable passing through said housing from said inlet to said outlet;

c. driving sheave means mounted for rotation in said housing, said driving sheave means having a circumferential groove for receiving said cable;

d. driving means connected to said driving sheave means;

e. a tensioning wheel mounted for rotation on said housing adjacent said inlet;

f. a pressure wheel mounted for rotation in said housing adjacent said driving sheave means, for urging said cable into said circumferential groove of said driving sheave means; and g. said pressure wheel being mounted between said tensioning wheel and said driving sheave means;
h. the axis of said pressure wheel being parallel to and movable relative to the axes of said tensioning wheel and said driving sheave means;
i. whereby tension on said cable causes said pressure wheel to urge said cable into said circumferential groove in direct relation to the degree of said tension.

10. A cable winch comprising
a. a housing with a cable inlet and a cable outlet;
b. a cable passing through said housing from said inlet to said outlet;
c. driving sheave means mounted for rotation in said housing, said driving sheave means having a circumferential groove for receiving said cable;
d. driving means connected to said driving sheave means;
e. a tensioning wheel mounted for rotation in said housing adjacent said inlet;
f. a centrifugal brake mounted adjacent said tensioning wheel for cooperating with said tensioning wheel to brake said cable;
g. a pressure wheel mounted for rotation in said housing adjacent said driving sheave means, for urging said cable into said circumferential groove of said driving sheave means; and
h. the axis of said pressure wheel being parallel to and movable relative to the axes of said tensioning wheel and said driving sheave means;
i. whereby tension on said cable causes said pressure wheel to urge said cable into said circumferential groove in direct relation to the degree of said tension.

11. A winch according to claim 10, wherein the centrifugal brake comprises an eccentrically, pivotally journalled brake jaw adapted to co-operate with the running through cable, and a locking mechanism for said jaw which is released when a specific rotational speed of the tensioning wheel is exceeded, whereby the pivotal brake jaw presses the running through cable against a fixed counter-jaw as a result of the motion of the running cable.

12. A winch according to claim 11, wherein the locking mechanism consists of a spring-loaded pin which normally engages in an opening provided in one side of the pivoting braking jaw and which is released by means of levers which are mounted on the tensioning wheel and which pivot outwards under centrifugal effect.

* * * * *